US005540569A

United States Patent [19]

Altham et al.

[11] Patent Number: 5,540,569

[45] Date of Patent: Jul. 30, 1996

[54] MULTIPLE-CHAMBER GEAR PUMP FOR INK JET PRINTING

[75] Inventors: Tim J. Altham, Castle Bytham, England; Paul A. Johnson, Vancouver, Wash.

[73] Assignee: Micropump, Inc., Vancouver, Wash.

[21] Appl. No.: 372,985

[22] Filed: Jan. 17, 1995

Related U.S. Application Data

[62] Division of Ser. No. 215,924, Mar. 22, 1994.

[51] Int. Cl.[6] ..... B14J 2/18

[52] U.S. Cl. ..... 417/420; 417/199.1; 417/199.2; 417/435; 417/439; 417/522; 418/200; 418/102; 347/85; 347/89

[58] Field of Search ..... 417/420, 199.1, 417/199.2, 435, 439, 522; 418/200, 102, 126; 184/6.12; 347/85, 89

[56] References Cited

U.S. PATENT DOCUMENTS 4,320,407 3/1982 Goldis et al. ..... 346/140
4,364,055 12/1982 Aiba ..... 346/1.1
4,464,668 8/1984 Komai et al. ..... 346/75
4,476,472 10/1984 Aiba et al. ..... 346/75
5,380,164 1/1995 Fry et al. ..... 417/250

*Primary Examiner*—Louis J. Casaregola
*Assistant Examiner*—Ted Kim
*Attorney, Agent, or Firm*—Klarquist Sparkman Campbell Leigh & Whinston, LLP

[57] ABSTRACT

Pump heads comprising at least two gear-pump chambers are disclosed. Each chamber comprises a housing which defines a corresponding pump cavity. Each cavity contains a driving gear and at least one driven gear and has a separate inlet and outlet. The pump cavities are hydraulically interconnected by a fluid conduit allowing passage whenever the pump chambers are pumping a fluid so as to generate a higher pressure in one cavity relative to the other cavity, of the fluid from the higher-pressure cavity to the lower-pressure cavity sufficient to maintain hydraulic prime of both cavities. The invention is particularly useful for ink jet printing applications.

4 Claims, 3 Drawing Sheets

MULTIPLE-CHAMBER GEAR PUMP FOR INK JET PRINTING

This is a division of application Ser. No. 08/215,924, filed Mar. 22, 1994.

FIELD OF THE INVENTION

This invention pertains to hydraulic pumps, particularly gear pumps.

BACKGROUND OF THE INVENTION

Gear pumps as known in the art are particularly advantageous for pumping fluids while keeping the fluids isolated from the external environment. This benefit has been further enhanced by the advent of magnetically coupled drive mechanisms which have eliminated leak-prone hydraulic seals around drive shafts.

Gear pumps have been adapted for use in many applications, including applications requiring extremely accurate delivery of a liquid to a point of use. Such applications include, for example, delivery of liquids in medical instrumentation and delivery of liquid ink to continuous ink-jet printer heads.

Continuous ink-jet printing is rapidly becoming the method of choice for on-line application of text, such as on alphanumeric production code or bar code, to each of multiple similar objects moving continuously and rapidly in a series manner such as on a production line. For example, continuous ink-jet printing is frequently used for on-line application of production code to canned goods and medical products.

Continuous ink-jet printing requires an uninterrupted delivery of a continuous stream of liquid ink from a reservoir to a printer head. The printer head is typically stationary. The printer head controllably disintegrates the stream into a continuous series of discrete microdroplets of liquid ink. The trajectory of each microdroplet is instantaneously adjusted. Certain microdroplets are directed to deposit on preselected locations on each object being printed so as to form the desired printed pattern on the surface of the object. Alphanumeric print (and many other printable patterns such as bar code) are discontinuous; also, printing the same pattern on a series of objects moving past the printer head inherently requires temporary interruptions in the flow of ink from the printer head to the objects being printed. Hence, any microdroplets not destined to form part of the printed pattern on the surface of the object must be scavenged while in flight. Scavenging is usually effected by directing unused microdroplets to a "gutter." Ink collected in the gutter is returned, usually by pumping, to the ink reservoir used to supply ink to the printer head.

Ink collected in the gutter usually contains a substantial quantity of air bubbles. The presence of bubbles places unusual demands upon the type and features of the pump employed for returning the ink to the reservoir. In contrast, pumping ink from the reservoir to the printer head usually does not present a problem.

In certain conventional continuous ink-jet printing systems, gear pumps are used for both pumping tasks. Alternatively, in other conventional systems for continuous ink-jet printing, a gear pump is employed for delivering ink from the reservoir to the printing head and a venturi, actuated by a stream delivered by the gear pump, is used to withdraw collected ink from the gutter. In such a system, proper operation of the venturi requires a pumping capacity, substantially greater than what is required to provide ink to the printing head, to create a sufficiently reduced pressure in the venturi.

Ongoing efforts to increase the efficiency and lower costs of equipment such as medical equipment and continuous ink-jet printing systems has stimulated interest in various hydraulic, including pump, improvements. For example, manufacturers have tried using only one pump motor coupled to two separate pump heads, thereby eliminating the cost of a separate pump motor for each pump head. Whereas efforts to date have been beneficial, further improvements are desired.

SUMMARY OF THE INVENTION

According to one aspect of the present invention, a multiple-chamber pump head is provided for pumping a fluid. The pump head comprises at least two gear-pump chambers. Each of the first and second gear-pump chambers comprises a housing which defines a corresponding pump cavity. Each pump cavity contains a set of gears comprising a driving gear and at least one driven gear intermeshed with the driving gear. In a preferred embodiment, the driving gears are coaxially interconnected such as by a drive shaft, wherein the drive shaft extends from one pump cavity to another in a manner facilitating rotation of the drive shaft about its longitudinal axis. In each housing, each corresponding driven gear is rotatably mounted so as to mesh with the corresponding driving gear and thus undergo contrarotation relative to the corresponding driving gear whenever the drive shaft is rotated about its longitudinal axis. Each chamber also comprises an inlet and an outlet which allow fluid to enter and exit, respectively, the pump cavity.

In a preferred embodiment of the multiple-chamber pump head, the drive shaft is journaled in a bearing extending between the housings. The bearing allows passage of fluid therethrough from one pump cavity to the other, in particular from the pump cavity normally having a higher internal pressure to the pump cavity normally having a lower internal pressure. This internal transfer of fluid from one pump cavity to another serves to maintain, inter alia, hydraulic prime of the pump cavity receiving such transferred fluid. Maintenance of prime in this manner is particularly advantageous whenever the pump cavity receiving fluid (i.e., the pump cavity having a lower internal pressure) is being used to deliver a liquid laden with a substantial amount of entrained air bubbles.

As an alternative or in addition to providing fluid passage through the bearing in which the drive shaft is journaled, it is also possible to provide a separate conduit permitting passage of fluid from the higher-pressure pump cavity to the lower-pressure pump cavity. The separate conduit can include one or more check valves, bleed valves, or other flow controllers as required.

A multiple-chamber pump head according to the present invention preferably comprises at least one each of two types of gear pumps known in the art, i.e., a "suction-shoe" pump, and a "cavity" pump. However, the present invention also comprehends multiple-chamber pump heads comprising two or more cavity pumps, suction-shoe pumps, or any combination of these and other types of gear pumps as defined herein. A combination of a suction-shoe pump and a cavity pump is especially preferred, particularly for use with continuous ink-jet printers, because performance of the cavity pump is relatively unperturbed by liquids containing substantial amounts of entrained air bubbles, such as present in ink collected in a gutter, and the suction-shoe pump is particularly useful for maintaining an elevated internal pressure relative to the cavity pump. As discussed above, this elevated pressure facilitates passage of liquid from the suction-shoe pump to the cavity pump, which serves to maintain prime of the cavity pump.

Pump heads according to the present invention are powered by an electric motor or other suitable prime mover. Coupling the pump head to the prime mover is preferably via a magnetic coupling or analogous means that eliminates a need for the rotary seal.

DETAILED DESCRIPTION

As used herein, a "gear pump" encompasses any of various pumps utilizing at least two impellers or rotors (i.e., "gears") that are contrarotated relative to each other in a casing or housing, wherein one of said gears is a "driving" gear and the remaining gears in the pump are "driven" gears. Each gear has multiple teeth or lobes, oriented radially with respect to the axis of rotation of the gear, that interdigitate (i.e., "mesh") with corresponding teeth or lobes, respectively, in the mating gear. As the gears are contrarotated, fluid enters the spaces between the teeth or lobes of each gear and is transported by the gears to a discharge port. The term "gear pump" also encompasses any of various "internal-gear" pumps as known in the art.

A "pump head" as used herein is an assembly comprising at least one functional gear pump.

A "multiple-chamber pump head" as used herein is a pump head according to the present invention that comprises two or more chambers, wherein each chamber comprises a functional gear pump. The gear pumps in the chambers, which need not be of the same type, function cooperatively as described herein.

A "cavity pump" is a gear pump comprising at least two meshed contrarotatable gears situated in a gear cavity defined by a housing that encloses the meshed gears. During operation, fluid entering the cavity pump moves around the gear cavity in the spaces between the gear teeth or lobes to a discharge, or outlet, port of the gear cavity.

A "suction-shoe pump" is a variant of a cavity pump characterized by the employment of a "suction shoe" (as described herein and, e.g., in U.S. Pat. No. 4,127,365 to Martin et al., incorporated herein by reference). The suction shoe hydraulically isolates the inlet port of the Dump from the outlet port sufficiently to eliminate the necessity for the cavity to conform closely to the profile of the meshed gears.

Figure 1:
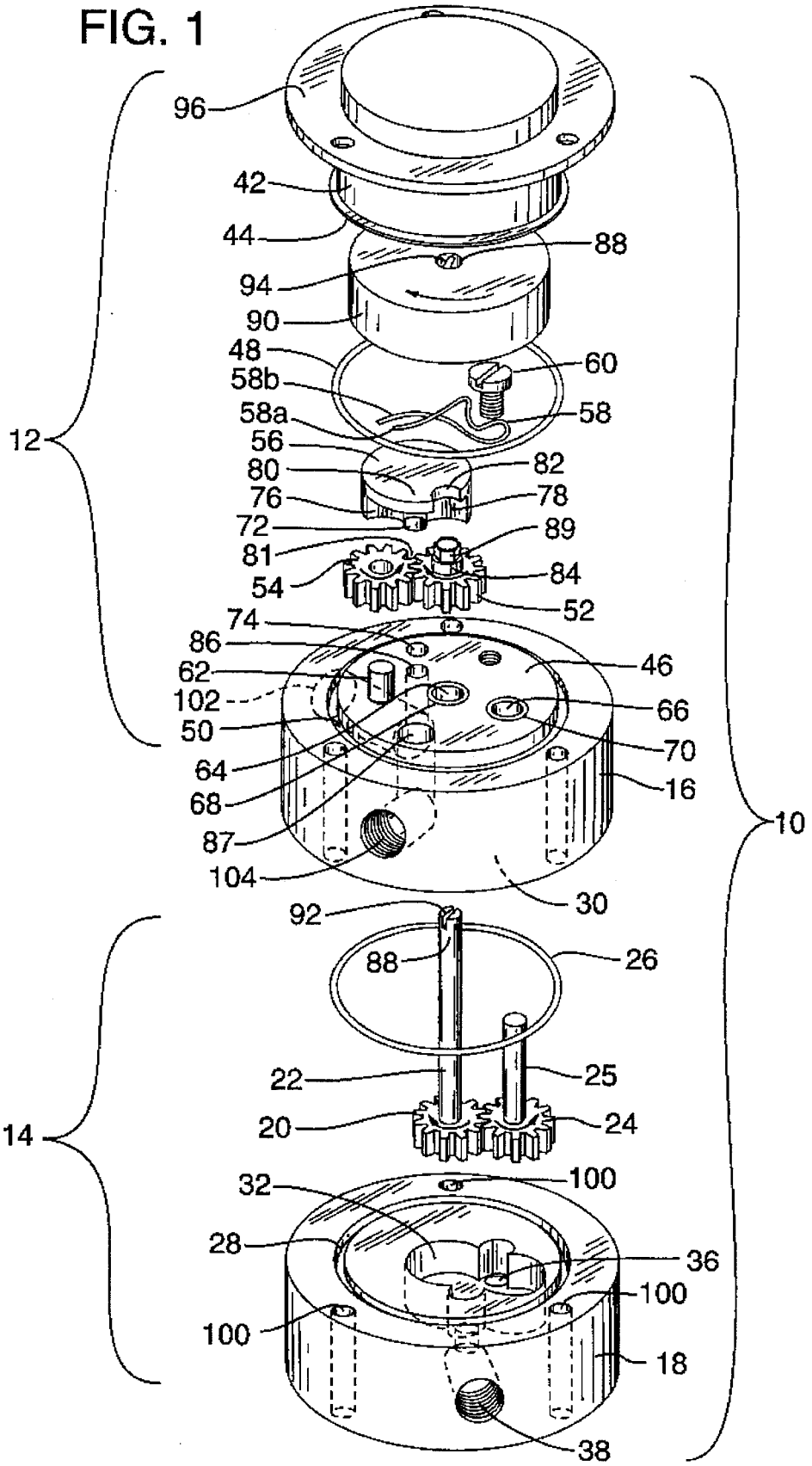
FIG. 1 is an exploded view of a preferred embodiment of a pump head according to the present invention comprising a suction-shoe pump portion and a cavity-pump portion.

A representative embodiment of a multiple-chamber pump head 10 according to the present invention is illustrated as an exploded view in FIG. 1. The components depicted in FIG. 1 are also shown in orthographic projection in FIGS. 2A, 2B, and 3.

In FIG. 1, the multiple-chamber pump head 10 comprises a "suction-shoe pump" portion 12 and a "cavity-pump" portion 14. A separator body 16 serves to, inter alia, partition the suction-shoe pump portion 12 from the cavity-pump portion 14.

The cavity-pump portion 14 comprises a cavity-pump body 18, a first driving gear 20 coaxially affixed to a drive shaft 22, a first driven gear 24 adapted to mesh with the first driving gear 20, and a static fluid seal 26 (such as, but not limited to, an elastomeric O-ring as shown captured in an annular gland 28 in a surface of the cavity-pump body 18). The first driven gear 24 is coaxially affixed to a shaft 25 to permit rotation of the first driven gear 24 about its axis. The cavity-pump body 18, together with a first surface 30 of the separator body 16, define a gear cavity 32 conforming to the profile and thickness of the meshed first driving gear 20 and first driven gear 24.

As in conventional cavity pumps, the gear cavity 32 is shaped so as to allow the first driving gear 20 and first driven gear 24 to freely rotate about their axes in the gear cavity 32 with minimal clearance between the gears 20, 24 and the walls of the gear cavity 32. (As can be readily appreciated, the gears 20, 24 rotate counter-currently relative to each other; i.e., they "contrarotate.") The gear cavity 32 also extends laterally outward to allow an inlet orifice 34 and an outlet orifice 36, both defined by the cavity-pump body 18, to open into the gear cavity 32. The inlet orifice 34 hydraulically communicates with an inlet port 38; and the outlet orifice 36 hydraulically communicates with an outlet port 40. The inlet and outlet ports 38, 40, respectively, can be threaded or otherwise made capable of accommodating any of various suitable hydraulic fittings as required. The inlet and outlet ports 38, 40 can be oriented in any convenient direction.

Figure 2A:
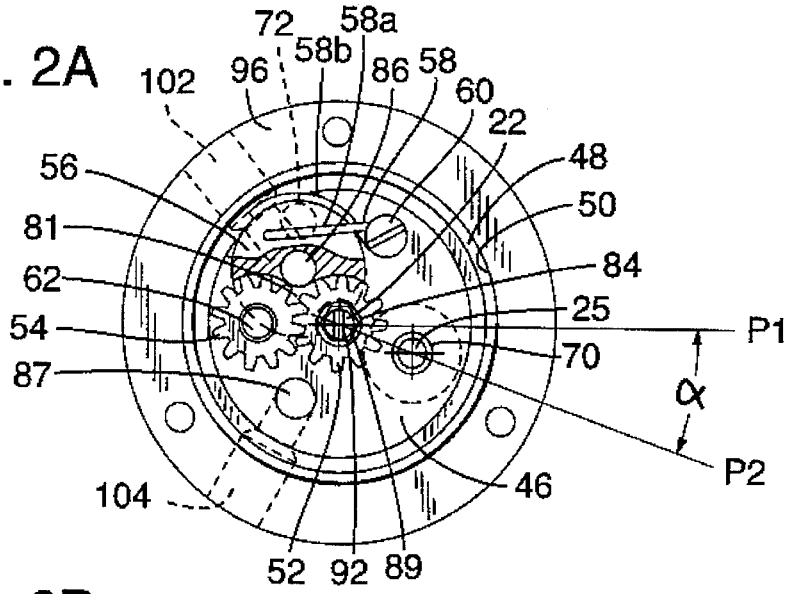
FIG. 2A is an axial view of the embodiment of FIG. 1, showing details of the suction-shoe pump portion.
Figure 2B:
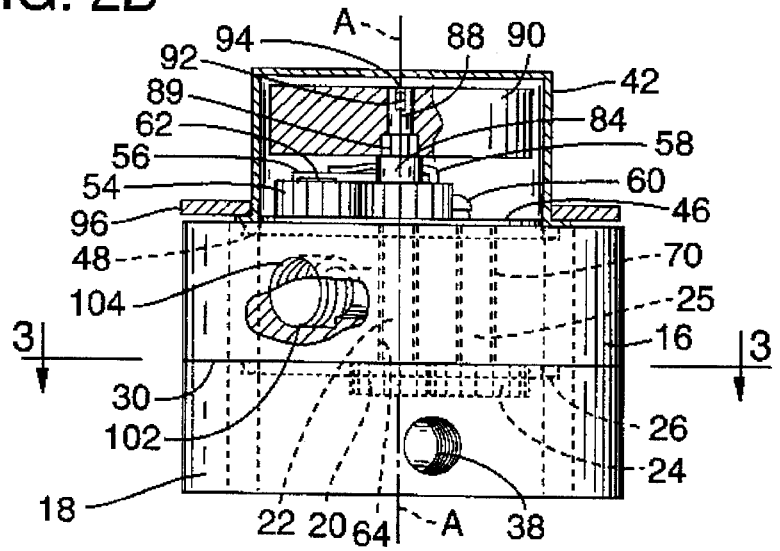
FIG. 2B is an elevational view of the embodiment of FIG. 1, showing certain of its components as fully assembled.

In the embodiment of FIGS. 1 and 2A–2B, the suction-shoe pump portion 12 comprises a cylindrical cup 42 having a closed end and, on the opposing open end, a flange 44 adapted to engage against a second surface 46 of the separator body 16. A seal 48 is used to facilitate sealing of the flange 44 to the separator body 16. The seal 48 can be an elastomeric O-ring as shown, captured in an annular gland 50, or can be any other analogous static seal appropriate for this application. Thus, the cup 42 and the second surface 46 of the separator body 16 together define a cavity in which are situated components of the suction-shoe pump, namely a second driving gear 52, a second driven gear 54, a suction shoe 56, a bias 58 for the suction shoe 56, and a screw 60 or analogous fastener for securing the bias 58 to the second surface 46. The second driven gear 54 is coaxially mounted on a short shaft 62 affixed to and extending from the second surface 46 so as to allow the second driven gear 54 to axially rotate relative to the shaft 62.

The shafts 22, 25 extend through and are journaled in corresponding orifices 64, 66 defined by the separator body 16. The orifices 64, 66 can be lined, if necessary or desired, with corresponding bushings 68, 70. (The bushings 68, 70 could be eliminated by fabricating either the separator body 16 or the shafts 22, 25, or both, from materials, including composite materials, having suitably low coefficients of friction.) As shown in FIG. 2B, the shaft 25 extends through the separator body 16 substantially to the second surface 46.

The shaft 22 also extends through the separator body 16 and projects from the second surface 46 to provide an axial mounting for the second driving gear 52. As a result of the shafts 22, 25 being journaled in the separator body 16 as shown in a manner allowing rotation about their respective axes, hydraulic communication occurs between the suction-shoe pump portion 12 and the cavity-pump portion 14, as described in further detail below. Specifically, a hydraulic "leak" is established from the suction-shoe pump portion 12 (representing a "higher-pressure" pump portion) to the cavity-pump portion 14 (representing a "lower-pressure" pump portion).

The suction shoe 56 is similar to suction shoes found in conventional suction-shoe gear pumps, as disclosed, for example, in U.S. Pat. No. 4,127,365 to Martin et al., incorporated herein by reference. For proper positioning, the suction shoe 56 is provided with a pin 72 adapted to fit into an orifice 74 defined by the separator body 16 and opening onto the second surface 46. The suction shoe 56 comprises a first arc-shaped edge 76 conforming with a portion of the circumference of the second driven gear 54, and a second arc-shaped edge 78 conforming with a portion of the circumference of the second driving gear 52, wherein both arc-shaped edges 76, 78 define a recess on the underside of the suction shoe. The suction shoe 56 also comprises a top portion 80 adapted to extend partially over the mesh point 81 of the second driving and driven gears 52, 54, respectively. Finally, the suction shoe 56 comprises a semicircular cutout 82 adapted to conform to a cylindrical shoulder 84 on the second driving gear 52.

The suction shoe 56 is preferably not rigidly mounted on the second surface 46. Rather, referring to FIG. 1 for example, the bias 58 (secured to the second surface using the screw 60) urges the suction shoe simultaneously toward the gears 52, 54 and toward the second surface 46, thereby minimizing clearance. In particular, one leg 58*a* of the bias 58 wraps part way around the circumference of the suction shoe 56 to urge the shoe 56 toward the mesh point 81 of the gears 52, 54; another leg 58*b*, which is bent in a dog-leg, urges the shoe 56 toward the second surface 46. Other bias means, in conformance with general principles of machine design, can alternatively be used as required to maintain proper positioning of the suction shoe 56 relative to the gears 52, 54.

When mounted to the second surface 46 with the bias 58 properly installed, the suction shoe 56 hydraulically isolates the immediate vicinity of an inlet orifice 86, together with the mesh point 81, from an outlet orifice 87 (both orifices being defined in the second surface 46 by the separator body 16). The first and second arc-shaped edges 76, 78, respectively, and the top portion 80 of the suction shoe 56 engage the second driven and driving gears 54, 52, respectively, in a manner allowing the gears 52, 54 to freely rotate about their respective axes with minimal clearance: (a) between the gears 52, 54 and the arc-shaped edges 78, 76, (b) between the gears 52, 54 and the top portion 80, and (c) between the gears 52, 54 and the second surface 46.

During operation of the suction-shoe pump portion 12, and as a result of the manner in which the suction shoe 56 is engaged against the gears 52, 54 and the second surface 46, an elevated pressure develops in the space defined by the cup 42 and the second surface 46 relative to the pressure at the inlet orifice 86. This elevated pressure, typically substantially equal to the discharge pressure of the suction-shoe pump portion, urges the suction shoe 56 against the second surface 46 and against the gears 52, 54, thereby further enhancing the role of the suction shoe 56.

This elevated pressure in the suction-shoe pump portion is also useful for facilitating fluid transfer from the suction-shoe pump portion 12 to the cavity-pump portion 14 sufficient to maintain hydraulic prime of the cavity-pump portion.

The second driving gear 52 is coaxially affixed to the shaft 22 extending through the orifice 64. For ease of assembly, it is preferred that the second driving gear 52 be affixed indirectly to the shaft 22 in a manner such as the following: The shaft 22 extends beyond the second surface 46 a distance sufficient to allow the second driving gear 52 to be coaxially slipped onto the shaft 22 while leaving a terminus 88 of the shaft exposed. A male spline 89, provided above and integral with the shoulder 84 of the second driving gear 52 is adapted to engage a corresponding female receptacle (not shown) concentrically and coaxially provided in a driven magnet 90, thereby allowing the driven magnet 90 to be coaxially mounted directly to the second driving gear. The terminus 88 of the shaft 22 is provided with a slot 92 adapted to engage a complementary key 94 provided in the driven magnet 90 to rotationally secure the driven magnet 90, and thereby also the second driving gear 52, to the shaft 22. It will be appreciated that any of various other ways of affixing the second driving gear 52 to the shaft 22 can be employed, according to general principles of machine design.

The cup 42 can be secured to the separator body 16 by a securing ring 96 adapted to engage the flange 44 of the cup (FIG. 2B) and urge the flange 44 against the seal 48. Screws 98 extending through the securing ring 96, the separator body 16, and into corresponding threaded orifices 100 in the cavity-pump body 18 secure the entire assembly 10 together.

In the suction-shoe pump portion 12, the inlet orifice 86 hydraulically communicates with a corresponding inlet port 102; and the outlet orifice 87 hydraulically communicates with an outlet port 104. The inlet and outlet ports 102, 104, respectively, can be threaded or otherwise made capable of accommodating any of various suitable hydraulic fittings as required. The inlet and outlet ports 102, 104 can be oriented in any convenient direction.

A multiple-chamber pump head 10, as shown in FIG. 1, preferably (for most applications including use with continuous ink-jet printer heads) comprises driving gears 20, 52 and driven gears 24, 54 that are all the same diameter, thickness, and pitch. As with conventional gear pumps, the driving gear (e.g., gear 20) and corresponding driven gear(s) (e.g., gear 24) in any particular pump portion preferably have the same diameter, thickness, and pitch to ensure even hydraulic flow through the corresponding pump portion. But, other applications for a pump head according to the present invention may favor using, for example, gear sets (driving plus driven gears) in the suction-shoe pump portion 12 that have a different diameter, thickness, and/or pitch than the gears in the cavity-pump portion 14. In some embodiments according to the present invention, such as an embodiment in which a pump portion comprises an "internal gear" configuration (as known in the art), the question of whether the driving and driven gear(s) in a pump portion have the same diameter is moot.

Across the thickness of the corresponding gears 20, 24, 52, 54, the gear teeth can be oriented parallel to the gear axis, as in ordinary spur gears, or can be helical or twisted to reduce pulsatility of flow.

The shaft 22, serving as a "drive shaft" in the embodiment of FIG. 1, need not be a single integral shaft. The shaft 22 can alternatively comprise several shaft elements connected together (not shown) so as to function as a single shaft or to otherwise cause driving gears 20, 52 to synchronously rotate about their rotational axis.

To increase the pumping capacity of a given pump portion, the respective driving gear can be meshed, in the same pump portion, with more than one driven gear. In instances in which the subject pump portion is a suction-shoe pump employing more than one driven gear, each driven gear in the pump portion would be provided with its own suction shoe (which, as described above, overlaps the corresponding driven gear and a portion of the driving gear). Thus, a suction-shoe pump portion employing a driving gear and two driven gears would be provided with two suction shoes, one for each driven gear.

The gears 20, 24, 52, 54 may be constructed of any suitable material to accommodate the fluid being propelled by the pump head 10, as well as the temperature, pressure, and viscosity involved. All other components can be fabricated of any material suitable for their intended purpose, either metallic, plastic, composite, ceramic, or any future material yet to be invented or discovered. The driven magnet 90 can be made of any suitable magnetic material compatible with the fluid to be pumped.

As shown most clearly in FIGS. 2A and 2B, the shaft 22 is preferably aligned with the radial axis A of the multiple-chamber pump head 10, thereby also placing the first and second driving gears on the radial axis A. In a manner typical of spur gears, the second driven gear 54 has a radial axis (not shown) that is parallel to A and laterally displaced from A in a plane P1 a sufficient distance so as to allow the second driving and driven gears 52, 54, respectively, to mesh. The axis of the first driven gear 24 can be in the same plane P1. The axis of the first driven gear 24 can also be in another plane P2 intersecting plane P1 at A. The most preferred arrangement is to orient the plane P2 relative to P1 at an angle $\alpha=90°/T$ wherein T=number of teeth in each of the first driving and driven gears 20, 24, respectively. Such an angle $\alpha$ is sufficient to offset the pitch of the first driven gear 24 relative to the second driven gear 54 by about ½ pitch. Such an offset has been discovered to minimize pulsatile pressure fluctuations in fluid delivered by the dual-chamber pump head 10.

Similarly, in instances (not shown) in which a pump portion comprises two driven gears, the axes of the driving gear and the first driven gear preferably reside in the plane P1 and the axes of the driving gear and the second driven gear preferably reside in the plane P2 with the angle $\alpha$ between P1 and P2 being the same as described above; i.e., $\alpha=90°/T$.

During operation of the pump head 10 shown in FIG. 1, fluid passes from the suction-shoe pump portion 12 to the cavity-pump portion 14 by flowing between the shaft 22 (FIG. 1) and its corresponding bearing and, if desired, between the shaft 25 and its corresponding bearing. (In a circuit as shown, for example, in FIG. 4, such passage of fluid is indicated by arrows 132.) Such fluid passage offers several benefits. First, and most importantly, the fluid passage maintains hydraulic prime of the cavity-pump portion 14, even whenever the cavity pump portion 14 is pumping an air-laden liquid. Second, the fluid passage serves to purge debris and other possible wear products away from the shafts and their bearings. Third, it provides for effective heat dissipation from the shafts and their bearings. Fourth, it maintains a fresh fluid bearing in the space between the shaft surface and the bearing surface. (The last three benefits provide for superior wear characteristics.)

Figure 3:
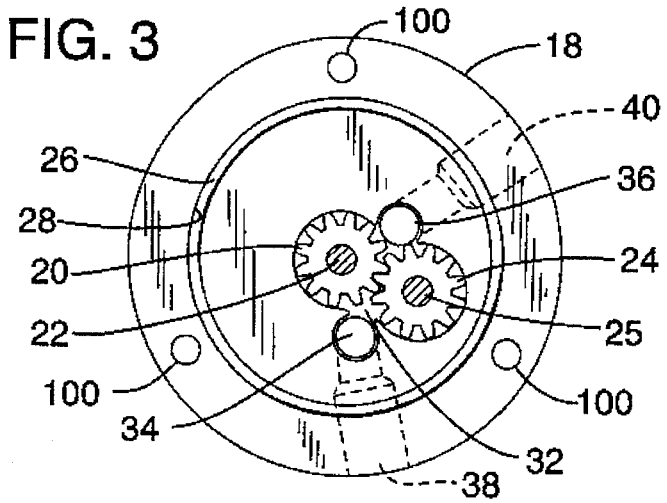
FIG. 3 is a sectional view of the embodiment shown in FIG. 2B, showing details of the cavity-pump portion.

Thus, the embodiment shown in FIGS. 1–3 provides one way in which fluid can be passed from a "higher-pressure" pump portion (e.g., the suction-shoe pump portion 12) to a "lower-pressure" pump portion (e.g., the cavity-pump portion 14) sufficient to maintain hydraulic prime of the lower-pressure pump portion. That is, FIGS. 1–3 depict passage of the fluid along a passage that is coaxial with the drive shaft (and hence coaxial with the driving gears). Another way to achieve such coaxial passage is to provide a hollow drive shaft.

The fluid passage need not, however, be coaxial with the driving gears. It is also possible to provide a separate, non-coaxial "bleed" conduit (not shown) connecting the higher-pressure pump portion to the lower-pressure pump portion. The bleed conduit can be provided with one or more check valves, adjustable flow restrictors, pressure-relief valves and/or other flow and pressure controllers as required for a particular application.

Particularly (but not necessarily) in instances in which fluid passes from one pump portion to the other via a non-coaxial bleed conduit, it is not necessary that a drive shaft extend from one pump portion to the other pump portion (or that a "drive" shaft actually rotate, so long as the driving gears can be made to rotate).

Figure 4:
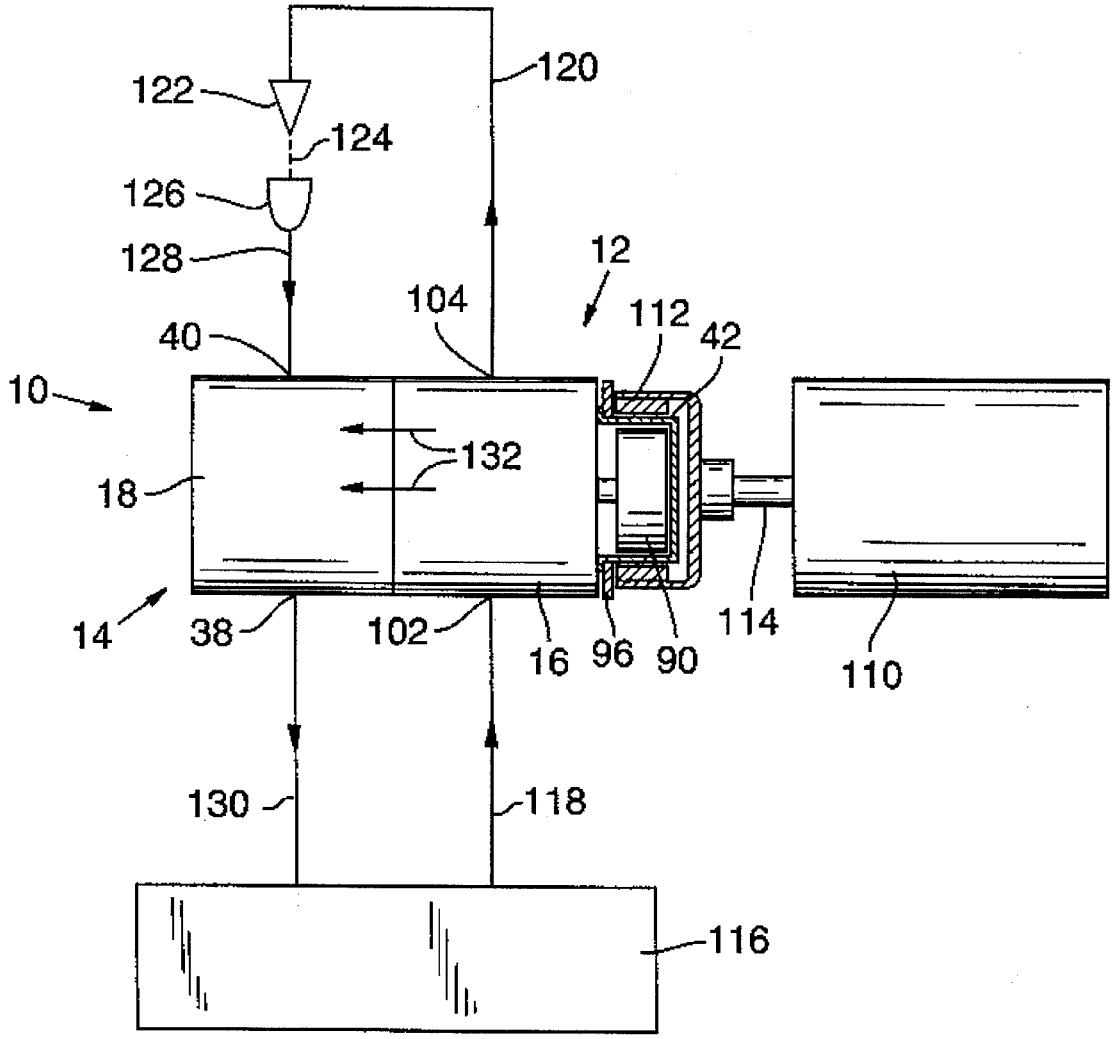
FIG. 4 is a schematic view of a hydraulic circuit in which a multiple-chamber pump head according to the present invention can be used to supply liquid ink to a continuous ink-jet printer head.

As shown schematically in FIG. 4, the multiple-chamber pump head 10 is preferably driven by an electric motor 110 magnetically coupled in a conventional manner to the magnet 90. One way in which this is achieved is by mounting an annular driving magnet 112 to the armature 114 of the electric motor 110, wherein the driving magnet 112 is positioned coaxially and circumferentially around the cup 42 so as to magnetically engage the magnet 90 inside the cup.

It is also possible to drive the driven magnet 90 using an "integrated motor" configuration as disclosed, for example, in U.S. Pat. Nos. 5,096,390 and 5,197,865, incorporated herein by reference.

Notwithstanding the foregoing, it will be understood that other types of prime movers (i.e., motors and the like) and other types of couplings (including direct couplings) between the prime mover and the pump head 10 can be employed. Alternative prime movers include, but are not limited to, hydraulic motors, mechanically actuated drive means, internal combustion engines, and any of various other prime movers capable of directly or indirectly imparting rotary motion to the driving gears. The magnetic coupling means described above can be replaced with any of various direct drives, pulley drives, gear drives, and analogous means according to the intended use and mechanical environment of the pump head 10 and generally understood principles of machine design. As is generally understood, using a magnetic coupling eliminates a need for passing a drive shaft from the external environment to inside the pump head 10, which would require a rotary seal.

The multiple-chamber pump head according to the present invention can be employed, inter alia, in any of various applications in which a liquid is delivered through a hydraulic circuit by application of a different pressure differential to the liquid at at least two different locations in the circuit. In such schemes, a first pump chamber of the pump head imparts the first pressure differential at a first location in the circuit and a second pump chamber of the pump head imparts the second pressure differential at a second location in the circuit. The pressure differentials are characterized in that a higher pressure exists in the first pump chamber relative to the second pump chamber, thereby facilitating passage of a stream of the liquid from the first pump chamber to the second pump chamber sufficient to maintain hydraulic prime of the second pump chamber.

The multiple-chamber pump head 10 disclosed in FIGS. 1–3 is particularly advantageous for use in a hydraulic scheme for supplying a continuous ink-jet printing head as shown schematically in FIG. 4. A reservoir 116 is provided for storing liquid ink. Ink is aspirated from the reservoir 116 through a conduit 118 coupled to the inlet port 102 of the suction-shoe pump portion 12. The outlet port 104 of the suction-shoe pump portion 12 is connected via a conduit 120 to the printing head 122. Droplets 124 not destined to be used for actual printing are scavenged in a gutter 126. Ink collected in the gutter 126 is routed through a conduit 128 coupled to the inlet port 40 of the cavity-pump portion 14. The outlet port 38 of the cavity-pump portion 14 is coupled to a conduit 130 which returns the scavenged ink to the reservoir 116, thereby completing the circuit. Thus, the suction-shoe pump portion 12 imparts a first pressure differential to the circuit and the cavity-pump portion 14 imparts a second pressure differential to the circuit.

The scavenged ink that is returned from the gutter 126 to the reservoir 116 is typically laden with air bubbles. One would expect, from a knowledge of the prior art, that such entrained air would cause unacceptable fluctuations in delivery of ink through conduit 120. But, in the pump head 10, a greater pressure develops inside the suction-shoe pump portion 12 relative to the cavity-pump portion 14. This pressure difference urges ink to pass from the suction-shoe pump portion 12 to the cavity-pump portion 14. Such passage of ink serves to maintain hydraulic prime of the cavity-pump portion 14 (despite the presence of air therein) and prevents air from entering the suction-shoe pump portion 12 from the cavity-pump portion 14. Also, the pressure gradient in the suction-shoe pump portion 12 between the inlet orifice 86 and the outlet orifice 87, as described above, contributes to the maintenance of a strong positive pressure in the suction-shoe pump portion 12 relative to the cavity-pump portion.

When used with continuous ink-jet printing heads and other applications requiring similar hydraulic performance, the multiple-chamber pump head 10 also eliminates the need for a venturi "pump" conventionally used in such hydraulic schemes for aspirating ink from the gutter. Eliminating the venturi "pump" by using a pump head according to the present invention offers several advantages: First, the necessity to provide a large excess pumping capacity in the hydraulic circuit upstream of the venturi to enable the venturi to generate sufficient subatmospheric pressure in order to operate is eliminated. Second, the frequently experienced necessity to reduce the viscosity of the fluid being pumped (such as by adding a solvent) in order to satisfactorily operate a venturi is eliminated, thereby alleviating possibly adverse environmental and other ramifications associated with use of solvents.

Even with continuous ink-jet hydraulic schemes not employing a venturi (but rather employing two separate pumps), employing a pump head according to the present invention eliminates the conventional need to provide an excess supply of fluid to the pump downstream of the gutter (compared to the supply of fluid entering the pump providing ink to the printing head). Thus, employing a pump head according to the present invention for such an application can allow substantial simplification of the hydraulic flow-path associated with a continuous ink jet printer.

Even though the multiple-chamber pump head 10 is particularly suitable for applications requiring small size and accurate performance, such as for continuous ink-jet printing head applications, it will be understood that the size of the pump head 10 is not critical. The pump head 10 can be of any suitable size and can be used for any application in which its particular attributes, as disclosed above, would be beneficial.

According to a preferred embodiment, a pump head according to the present invention preferably comprises a suction-shoe pump portion and a cavity-pump portion. Other possible combinations according to the present invention, such as (but not limited to) all pump portions being suction-shoe pumps or cavity pumps, or any of various other gear-pump types, may be more suitable for other applications.

It is also comprehended that more than two pump portions can be incorporated into a multiple-chamber pump head according to the present invention, wherein each pump portion allows fluid to "leak" to the adjacent pump portion as described above.

It is also comprehended that the pump portions of a multiple-chamber pump head according to the present invention can be hydraulically connected in series or parallel in a hydraulic circuit. For example, the pump portions can be used in tandem to provide a "boosted" output.

In pump heads comprising more than two pump portions, it is preferable for the driving gears to be mounted coaxially on a single shaft or on shafts axially aligned and interconnected with each other so as to function as a single drive shaft. It is also possible for separate drive shafts in each pump portion to not be axially aligned while being mechanically interconnected (such as by using gears, pulleys and belts, or other analogous means) in a way causing the shafts to rotate synchronously as if they were mounted on a single shaft.

It will be apparent that a pump head according to the present invention can be incorporated into a manifold including some or all the various hydraulic conduits connected to the inlets and outlets of the pump head. Such manifolds are advantageous because they minimize conduit lengths and use of discrete hydraulic fittings and the like, thereby reducing the number of possible locations in the hydraulic circuit at which leaks can occur.

While the invention has been described in connection with a preferred embodiment and variations thereof, it will be understood that the invention is intended to comprehend all alternatives, modifications, and equivalents as may be included within the spirit and scope of the invention as defined by the appended claims.

What is claimed is:

1. A hydraulic circuit for supplying liquid ink to a continuous printing head for application to an object and for collecting and recycling ink that has passed through the printing head but not applied to the object, the circuit comprising:

(a) a printing head adapted to apply liquid ink to an object;

(b) a reservoir for containing a supply of liquid ink for use by the printing head;

(c) a gutter for collecting ink that has passed through the printing head but is not intended to be applied to the object;

(d) A multiple-chamber pump head comprising a first gear-pump chamber and a second gear-pump chamber, the first gear-pump chamber comprising a first housing defining a first pump cavity; a first driving gear situated within the first pump cavity and rotatable about a first axis that is fixed relative to the first housing; a first driven gear situated within the first pump cavity and rotatable about a second axis so as to mesh with the first driving gear and contrarotate about the second axis relative to the first driving gear whenever the first driving gear is rotating about the first axis; a first inlet allowing fluid to enter the first pump cavity so as to be propelled by the rotating first driving and driven gears through the first pump cavity; and a first outlet allowing fluid, propelled through the first pump cavity by the rotating meshed first driving and driven gears, to exit the first pump cavity;

the second gear-pump chamber comprising a second housing defining a second pump cavity; a second driving gear situated within the second pump cavity and axially connected to the first driving gear so as to be rotatable about the first axis synchronously with the first driving gear; a second driven gear situated within the second pump cavity and rotatable about a third axis fixed relative to the second housing so as to mesh with the second driving gear and contrarotate relative to the second driving gear whenever the second driving gear is rotating about the first axis; a second inlet allowing fluid to enter the second pump cavity so as to be propelled by the meshed second driving and driven gears through the second pump cavity; and a second outlet allowing fluid, propelled through the second pump cavity by the rotating second driving and driven gears, to exit the second pump cavity; and the first and second pump cavities being interconnected by a fluid conduit coaxial with the first axis, the conduit allowing, whenever the first and second gear-pump chambers are pumping fluid so as to generate a higher pressure in the first pump cavity relative to the second pump cavity, fluid to pass from the first pump cavity to the second pump cavity so as to maintain hydraulic prime of both the first and second pump cavities;

(e) a hydraulic circuit for conducting ink from the reservoir to the second inlet, from the second outlet to the printing head, from the gutter to the first inlet, and from the first outlet to the reservoir; and (f) a prime mover operably coupled to the pump head so as to cause rotation of the first driving gear about the first axis.

2. A hydraulic circuit for supplying liquid ink to a continuous printing head for application to an object and for collecting and recycling ink that has passed through the printing head but not applied to the object, the circuit comprising:

(a) a printing head adapted to apply liquid ink to an object;

(b) a reservoir for containing a supply of liquid ink for use by the printing head;

(c) a gutter for collecting ink that has passed through the printing head but is not intended to be applied to the object;

(d) a multiple-chamber pump head comprising a first gear-pump chamber and a second gear-pump chamber, the first gear-pump chamber comprising a first housing defining a first pump cavity; a first driving gear situated within the first pump cavity and rotatable about a first axis that is fixed relative to the first housing; a first driven gear situated within the first pump cavity and rotatable about a second axis fixed relative to the first housing so as to mesh with the first driving gear and contrarotate about the second axis relative to the first driving gear whenever the first driving gear is rotating about the first axis; a first inlet allowing fluid to enter the first pump cavity so as to be propelled by the rotating first driving and driven gears through the first pump cavity; and a first outlet allowing fluid, propelled through the first pump cavity by the rotating meshed first driving and driven gears, to exit the first pump cavity;

the second gear-pump chamber comprising a second housing defining a second pump cavity; a second driving gear situated within the second pump cavity and rotatable about a third axis that is fixed relative to the second housing, the second driving gear being operably coupled to the first driving gear so as to cause the second driving gear to rotate about the third axis whenever the first driving gear is rotated about the first axis; a second driven gear situated within the second pump cavity and rotatable about a fourth axis fixed relative to the second housing so as to mesh with the second driving gear and contrarotate relative to the second driving gear whenever the second driving gear is rotating about the third axis; a second inlet allowing fluid to enter the second pump cavity so as to be propelled by the meshed second driving and driven gears through the second pump cavity; and a second outlet allowing fluid, propelled through the second pump cavity by the rotating second driving and driven gears, to exit the second pump cavity, and the first and second pump cavities being hydraulically interconnected by a fluid conduit allowing, whenever the first and second gear-pump chambers are pumping fluid so as to generate a higher pressure in the first pump cavity relative to the second pump cavity, fluid to pass from the first pump cavity to the second pump cavity so as to maintain hydraulic prime of both the first and second pump cavities; and (e) a hydraulic conduit for conducting ink from the reservoir to the second inlet, from the second outlet to the printing head, from the gutter to the first inlet, and from the first outlet to the reservoir.

3. A hydraulic circuit as recited in claim 2 further comprising a prime mover operably coupled to the pump head so as to cause rotation of the first driving gear about the first axis.

4. A hydraulic circuit as recited in claim 3 wherein the prime mover is an electric motor.

* * * * *